US008596074B2

(12) United States Patent
Nilsson et al.

(10) Patent No.: US 8,596,074 B2
(45) Date of Patent: Dec. 3, 2013

(54) GAS TURBINE COMBUSTOR

(75) Inventors: Ulf Nilsson, Whetstone (GB); Peter Senior, Levittown, PA (US)

(73) Assignee: Siemens Aktiengesellschaft, München (DE)

( * ) Notice: Subject to any disclaimer, the term of this patent is extended or adjusted under 35 U.S.C. 154(b) by 999 days.

(21) Appl. No.: 12/226,069

(22) PCT Filed: Apr. 4, 2007

(86) PCT No.: PCT/EP2007/053281

§ 371 (c)(1),
(2), (4) Date: May 20, 2009

(87) PCT Pub. No.: WO2007/115989

PCT Pub. Date: Oct. 18, 2007

(65) Prior Publication Data

US 2009/0320490 A1 Dec. 31, 2009

(30) Foreign Application Priority Data

Apr. 7, 2006 (EP) ..... 06007402

(51) Int. Cl.
*F23R 3/14* (2006.01)
*F23R 3/28* (2006.01)
*F23R 3/36* (2006.01)

(52) U.S. Cl.
USPC ..... 60/772; 60/737; 60/748

(58) Field of Classification Search
USPC ..... 60/772, 737, 748
See application file for complete search history.

(56) References Cited

U.S. PATENT DOCUMENTS

| | | | | |
|---|---|---|---|---|
| 4,343,148 | A | 8/1982 | Shekleton | |
| 4,932,861 | A * | 6/1990 | Keller et al. | 431/8 |
| 5,489,203 | A * | 2/1996 | Dobbeling et al. | 431/173 |
| 5,562,441 | A * | 10/1996 | Dobbeling et al. | 431/351 |
| 5,569,020 | A * | 10/1996 | Griffin et al. | 60/39.822 |
| 5,588,824 | A * | 12/1996 | McMillan | 431/285 |
| 5,896,739 | A * | 4/1999 | Snyder et al. | 60/748 |
| 5,941,075 | A | 8/1999 | Ansart et al. | |
| 5,954,490 | A | 9/1999 | Knoepfel et al. | |
| 6,050,096 | A * | 4/2000 | Senior | 60/748 |
| 6,769,903 | B2 * | 8/2004 | Eroglu et al. | 60/737 |
| 2001/0027637 | A1 | 10/2001 | Norster et al. | |
| 2003/0084667 | A1 | 5/2003 | Gerendas et al. | |

FOREIGN PATENT DOCUMENTS

| | | | |
|---|---|---|---|
| DE | 100 26 122 | A1 | 11/2001 |
| EP | 0 833 105 | A2 | 4/1998 |
| EP | 1 340 942 | A2 | 9/2003 |
| EP | 1 408 280 | A2 | 4/2004 |
| EP | 1 507 119 | A1 | 2/2005 |

* cited by examiner

*Primary Examiner* — Ted Kim

(57) ABSTRACT

A gas turbine combustor is provided, which comprises: a combustion chamber having an axial direction and a radial direction; air passages for feeding an air stream into the combustion chamber which are oriented such that the flowing direction for each air stream flowing into the combustion chamber includes an angle with the combustion chamber's radial direction so as to introduce a swirl in the in-flowing air and an angle of at least 60° with the combustion chamber's axial direction; and fuel injection openings which are located in the air passages. Each air passage defines a turning flow path with a turning between 70° and 150° in a radial direction of the combustion chamber and a turning between 0° and 235° in an axial direction of the combustion chamber.

10 Claims, 6 Drawing Sheets

GAS TURBINE COMBUSTOR

CROSS REFERENCE TO RELATED APPLICATIONS

This application is the US National Stage of International Application No. PCT/EP2007/053281, filed Aug. 4, 2003 and claims the benefit thereof. The International application claims the benefits of European application No. 06007402.8 filed Apr. 7, 2006, both of the applications are incorporated by reference herein in their entirety.

FIELD OF THE INVENTION

The present invention relates to a gas turbine combustor comprising a combustion chamber having an axial direction and a radial direction.

BACKGROUND OF THE INVENTION

A combustor comprising a combustion chamber having an axial direction and a radial direction is, e.g., described in U.S. Pat. No. 6,532,726 B2. The combustor described therein consists of a burner with a burner head portion to which a radial inflow swirler is attached, a combustion pre-chamber and a combustion main chamber following the pre-chamber in an axial direction of the combustor. The main chamber has a diameter larger than that of the pre-chamber. The swirler defines a number of straight air passages between swirler vanes. Each air passage extends along a straight line which is perpendicular to the axial direction of the combustor. Moreover, this straight line has an inclination angle relative to the radial direction of the combustor so that the in-streaming air has a tangential component with respect to a circle around the combustor's axial direction. The direction of air streaming through the swirler into the pre-chamber has therefore a radial and a tangential component with respect to said circle. The main fuel for the combustion process is introduced into the air stream streaming through the air passages. The burner is a so-called premix burner in which a fuel and air are mixed before the mixture is burned.

The concept of pre-mixing fuel and air is generally used in modern gas turbine engines for reducing undesired pollutants in the exhaust gas of the combustion. There are two main measures by which a reduction of pollutants is achievable. The first is to use a lean stoichiometry, e.g. a fuel/air mixture with a low fuel fraction. The relatively small fraction of fuel leads to a combustion flame with a low temperature and thus to a low rate of nitrous oxide formation. The second measure is to provide a thorough mixing of fuel and air before the combustion takes place. The better the mixing is, the more uniformly distributed the fuel in the combustion zone. This helps to prevent hot spots in the combustion zone which could arise from relative local maxima in the fuel/air mixing ratio, i.e. zones with high fuel/air mixing ratio compared to the average fuel/air mixing ratio in the combustor.

SUMMARY OF THE INVENTION

It is therefore an objective of the present invention to provide a combustor, in particular a gas turbine combustor, by which a thorough mixing of fuel and air is achievable. This object is solved by a combustor according to the independent claim. The depending claims define further developments of the inventive combustor.

An inventive combustor, which, in particular, may be implemented as gas turbine combustor, comprises a combustion chamber having an axial direction and a radial direction, air passages for feeding an air stream into the combustion chamber and fuel injection openings which are located in the air passages. The air passages are oriented such that the flowing direction of each air stream flowing into the combustion chamber includes an angle with the combustion chambers radial direction so as to introduce a swirl in the in-flowing air and an angle of at least 60° with the combustion chambers axial direction. Each air passage defines a turning flow path with a turning between 70° and 150° in a radial direction of the combustion chamber and a turning between 0° and 180°, or even between 0° and 235°, in an axial direction of the combustion chamber. However, the turning could also be restricted to the range between 0° and 90°, in particular to the range between 15° and 75°. It shall be noted that the combustion chamber may, in particular, comprise a pre-chamber and a main chamber following the pre-chamber in axial direction of the combustor. The pre-chamber may, however, also be regarded as a part of the burner. In this view it could also be referred to as a transition section of the burner.

With the approach of using curved air passages, a cross stream circulation around the longitudinal axis of the burner, which extends in a downstream direction of the combustor, is generated. The cross stream circulation is then used to take fuel from a more limited number of injection points, compared to the state of the art combustor, and distributed. At the same time, the cross stream air circulation efficiently generates fine scale turbulence, to provide an intimate mixing needed for low emissions.

Although a number of methods for achieving an even premixture of fuel and air are known in the state of the art, the practical use of these state of the art methods within gas turbine burners means accepting compromises which make current NOx-performance an order of magnitude worse than is demonstrably achievable with perfect pre-mixture. Intimate mixing of fuel and air required to sustain low emissions combustion currently involves either:

1. High pressure loss devices using separation zones and high swirls to generate larger amounts of small scale turbulence at the cost of impacting energy efficiency.
2. Low pressure loss devices with long pre-mixing zones which are sensitive to combustion pulsation and premature burning of fresh fuel.
3. A large number of fuel injection ports to achieve a fine initial distribution. This approach increases the required manufacturing effort and sensitivity of the emissions performance to tolerances, in-service wear or blockage.

Prior art solutions, apart from those resorting to sensitive and complex chemical means such as catalysts, may be seen to be some combination of the three basic approaches mentioned above.

With burners relying on fuel injection momentum for fuel placement, the injection depth of the fuel is a function of the orifice size, placement and relative momenta of air and fuel streams. The performance in relation to theory, therefore, worsens away from the designed optimal operating condition, which is usually chosen as the full engine power. This change in fuel placement also changes acoustic characteristics of the burner thereby making it sensitive to changes in both operating load and ambient operating conditions (e.g. intake air), which usually forces piloting to maintain stability, further compromising emissions performance.

Other known approaches which involve adding turbulence generating features of various kinds to the passage walls are generally much more difficult to manufacture accurately and repeatedly than the curved air passages of the inventive combustor and can have the added disadvantage of introducing circulation vectors against the flow direction, which in turn reduces the ability of a pre-mixed burner to resist premature ignition. Since in such cases the burner and/or even the engine is usually damaged significantly, the advantage of curved air passages is obvious.

The curved air passages of the inventive combustor may, e.g., be implemented in a combustor as described in U.S. Pat. No. 6,532,726 B2 by altering the cutting track of a milling tool used to machine the swirler so that the passages become curved in the radial and the axial direction. This provides the ability to produce the inventive combustor with very low extra cost, if at all, compared to the combustor described in U.S. Pat. No. 6,532,726 B2. The curved air passages can be adapted to give much more freedom in setting the ratios of axial to radial to tangential momentum in the air stream then can be achieved with the straight-passage radial design of U.S. Pat. No. 6,532,726 B2. In itself this can give a further pressure loss benefit. The geometry of the passage also means that any liquid fuel which strikes the passage walls and follows them during extreme off-design conditions such as start up can be launched towards the burner exit to improve the cleanliness and start burn efficiency.

With respect to the described prior art burner, fewer fuel injection points can be chosen by reference to the passage circulation created so that the circulation "pulls" the fuel around the whole of the air stream where it is then mixed by the extra fine scale turbulence caused by the circulation itself. This phenomenon is known from turbine blading where cooling air from film holes experiences a similar fate. However, in the turbine case the effect is detrimental not beneficial and considerable ingenuity is applied to try to mitigate and suppress it! Further, because the distribution of fuel is more dominated by the air flow with the current curved air passages, the mixing and hence burner acoustics and emissions become far less sensitive to fuel flow changes at different operating points. Furthermore, the fuel placement then also automatically adapts to changes in the air intake conditions. The improvement in aerodynamic robustness means that emission generating pilot fuel can be reduced or even eliminated completely at high loads. This is particularly relevant for dry low emission combustion of liquid fuels where the sensitivity to fuel flow is even higher because droplet size also changes with throughput. Reduction of pilot fuel compared to prior art solutions is particularly attractive.

The already mentioned alleviation of the impacts of the basic state of the art approaches 1-3 can be taken either as improved mixing in order to get reliable operation at much lower NOx levels, or by reducing pressure loss in order to enhance the engine efficiency. A further option is to take the opportunity of reduced pressure loss to feed all combustor cooling air in series through the burner, thereby increasing the firing capacity of the machine for a given combustor temperature and thus drastically increasing machine power output at the same emissions and component life levels. Therefore, in a further development of the inventive combustor, the inlet openings of the air passages are in flow connection with cooling channels of the combustion chamber for cooling of the combustion chambers.

A further option arising from the mentioned alleviation is to use the enhanced emissions versus complexity trade-off to drastically simplify the burner construction necessary to achieve a given NOx level. This would lower costs and thus make the product more competitive. For instance, fewer air passages in the swirler can be realized. This would ease the design constrains on incorporating assembly bolts, fuel galleries, igniters and sensor ports into the burner. Deconstraining any of these elements might allow their movement to a position which significantly enhances their current effectiveness and/or robustness.

In the inventive combustor, the dimensions of the air channels may vary during the turning in the radial direction. By this measure specific streaming properties can be achieved by suitably setting the dimensions of the air channels.

To increase the freedom of fuel injection, fuel injection openings could be located in at least two different locations in the air passages. One can then influence the mixing of air and fuel by setting ratios of fuel delivery through different fuel injection openings in different locations.

The inventive burner can comprise, as fuel injection openings, liquid fuel injection openings for injecting a liquid fuel and/or gaseous fuel injection openings for injecting a gaseous fuel into the air streams through the air passages.

In a specific development of the invention, the exit direction of the air streaming out of the air passages is kept at an angle greater than 45° to the combustor's radial axis, and in particular greater than 60° to the combustor's radial axis.

In a special embodiment of the present inventive combustor first and second air passages are present, each defining a turning flow path with a turning between 70° and 150° in a radial direction of the combustion chamber and the turning between 0° and 90° in an axial direction of the combustion chamber. In this embodiment the first and second air passages are interlocked with each other so as to form alternating geometries of the air passages. By the alternating geometries an effect could be introduced whereby the circulating flows emerging from two passages wrap around each other (like conductors in a twisted pair cable). Such flows are known to produce orders of magnitude increases in mixing performance and also in flow strain which may finally render possible under gas turbine conditions the highly strained flameless oxidation which is known to be very effective in atmospheric equipment, and which may out perform even perfectly pre-mixed combustion. Because of the distributed nature of the heat release zone, such highly-strained flames could also be much less prone to thermodynamic pulsation than normal pre-mixed flames. This of course would remove a major limitation/concern for reliable gas turbine operation.

BRIEF DESCRIPTION OF THE DRAWINGS

Further features, properties and advantages of the present invention will become clear by the following description of specific embodiments of the invention with reference to the accompanying drawings.

DETAILED DESCRIPTION OF THE INVENTION

Figure 1:
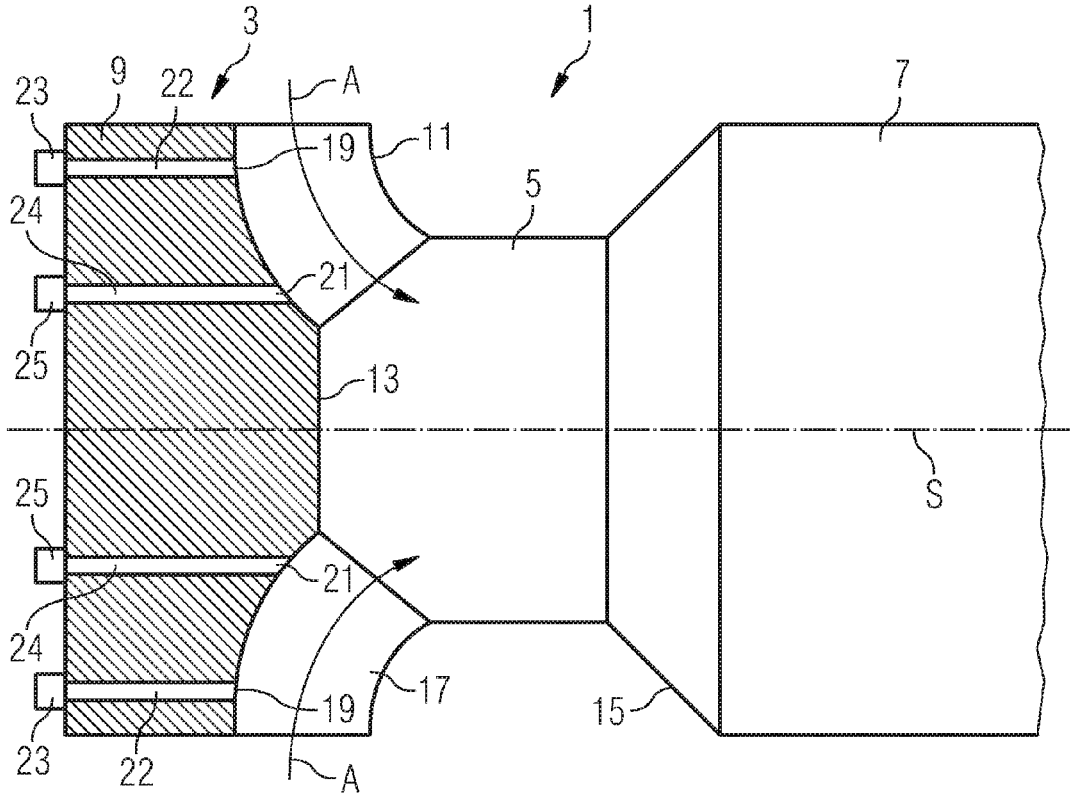
FIG. 1 schematically shows an inventive combustor.

A combustor comprising an inventive burner will now be described with reference to FIG. 1, which schematically shows a combustor 1 comprising in flow series a burner 3, a pre-chamber 5 and a main chamber 7. The burner 3 includes a burner head 9 and a swirler 11 to which the burner head 9 is attached. An end face 13 forms the upstream end of the pre-chamber 5. The pre-chamber 5 is of smaller diameter than the main chamber 7, which is attached to the pre-chamber through a dome portion 15. The combustor shows, in general, rotational symmetry with respect to an axial symmetry axis S extending through the burner 3, the pre-chamber 5 and the main chamber 7. Although the combustor and the dome may also be an annular unit with multiple swirlers.

In operation, compressed air flows along the stream path indicated by arrows A into the pre-chamber 5. Thereby it flows through the air passages 17 of the swirler 11. Fuel injection openings 19 and 21 are located inside the swirler 11 in the flow path of the intake air, i.e. in the air passages 17 of the swirler 11. The fuel injection openings 19, 21 my be gaseous or liquid fuel injection openings or both. Through the fuel injection openings 19, 21, which are fed by connectors 23 and 25 and ducts 22, 24 extending from the connectors 23, 25 to the injection openings 19, 21 fuel can be injected into the air flowing through the air passages 17. Due to the swirling action of the swirler 11 air and fuel mixes before the mixture enters the pre-chamber 5 where the combustion is ignited, e.g. by an electric igniter unit (not shown). Once lit, the flame continues to burn without further assistance from such igniter. A pilot fuel injection system (not shown) included into the burner 11 assists the combustion in order to stabilize the flame.

The shown combustor 1 may either be operated with gaseous or liquid fuel.

In the combustor 1, the air passages 17 define a turning flow path with a turning of about 150° in a radial direction of the combustion chamber and a turning of about 45° in an axial direction of the combustion chamber, i.e. in the direction in which the symmetry axis S extends. The turning angle $\alpha$ (see FIG. 2*a*) in the axial direction is not restricted to 45°. In fact, it may assume any value between 0° and 90°. The turning angle $\theta$ (see FIG. 2*b*) in the radial direction, which may be between 70° and 150°, directs energy equivalent to between 1 and 1.7 times the flow dynamic head into generating a secondary flow which redistributes the fuel.

The exit portions 29 of the air passages 17 are oriented such with respect to the radial direction of the combustor 1 that the air fuel mixture leaving the air passages 17 includes an angle $\gamma$ (see FIG. 2*b*) with respect to the radial direction of the combustor 1 so as to introduce a swirl in the fuel air mixture. In the present embodiment, the exit portions 29 are oriented such that the fuel/air mixture flowing into the pre-chamber 3 includes angles an angle $\beta$ (see FIG. 2*a*) of at least 60° with the symmetry axis S of the combustor 1.

Figure 2A:
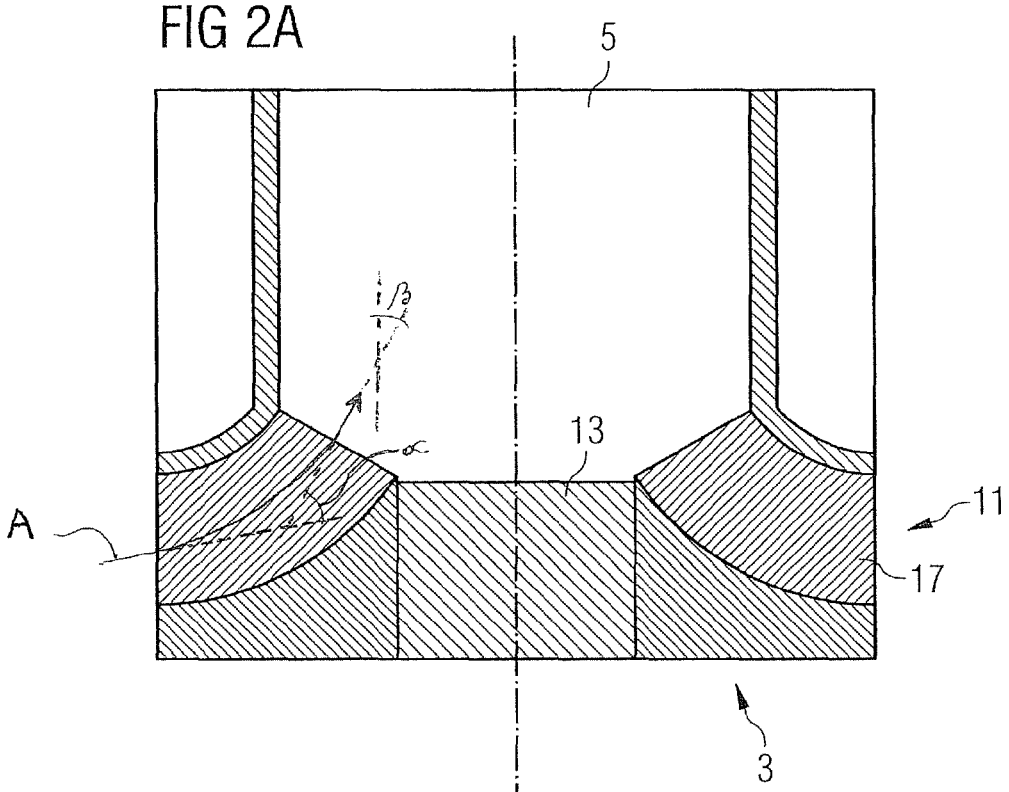
FIGS. 2*a* and 2*b* schematically show the first embodiment of the inventive combustor.
Figure 2B:
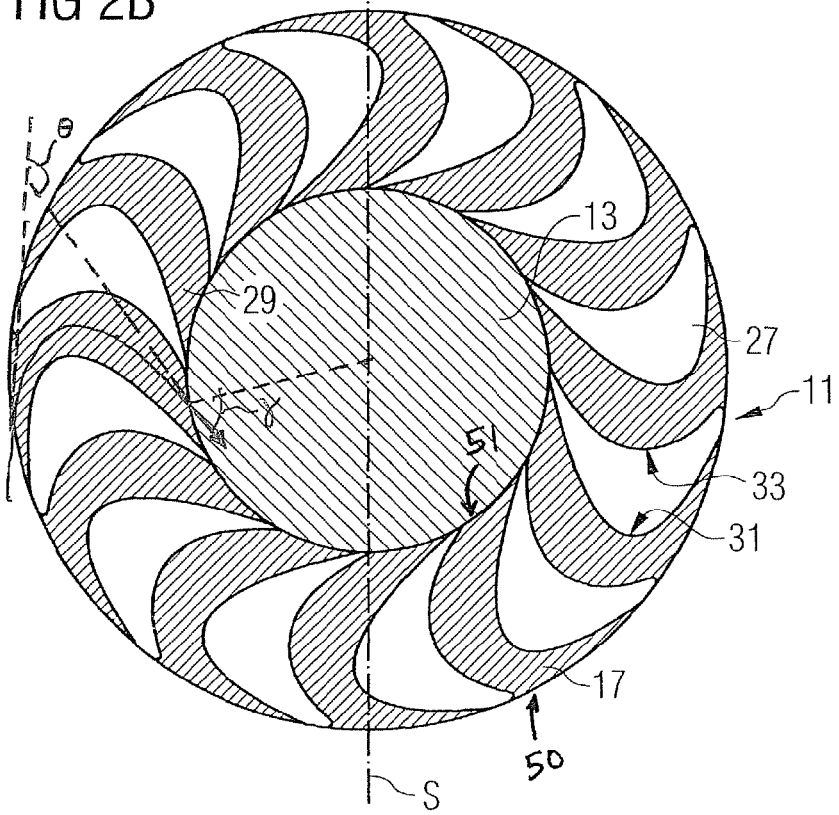

The geometry and curvature of the air passages 17 is shown in greater detail in FIGS. 2*a* and 2*b*. FIG. 2*a* shows the swirler 11, the burner 3 and the pre-chamber 5 in a longitudinal section, and FIG. 2*b* shows the swirler 111 in a radial section. As can be best seen in FIG. 2*b* the air passages 17 are formed between vanes 27 which show a convex curvature on a first side 31 and a concave curvature on a second side 33 lying opposite to the first side. As clearly shown in FIG. 2*b*, each air passage 17 guides the flow therethrough from a radial outer inlet 50 to a radially inner outlet 51. The air passages 17 are located between the convex first side 31 of vane 27 and the convex second side 33 of a neighboring vane 27. As the peaks of the convex curved side 31 and the concave curved side 33 are not located on the same radius with respect to the symmetry axis S the distance between the surfaces of neighboring vanes varies so that the diameter of the air passages 17 varies as well. However, non varying diameters are possible as well.

Referring to FIG. 2A and FIG. 2B, the angle $\alpha$ denotes the turning angle defined by the air passage 17 in the axial direction; the angle $\theta$ denotes the turning angle defined by the air passage in the radial direction; the angle $\beta$ denotes the angle of the air stream with the axial direction when the air stream enters the pre-chamber; and the angle $\gamma$ denotes the angle of air stream with respect to the radial direction as the air stream enters the pre-chamber.

Although twelve air passages are shown in the swirler of FIG. 1 the swirler 11 may have more or less than twelve air passages.

Figure 3A:
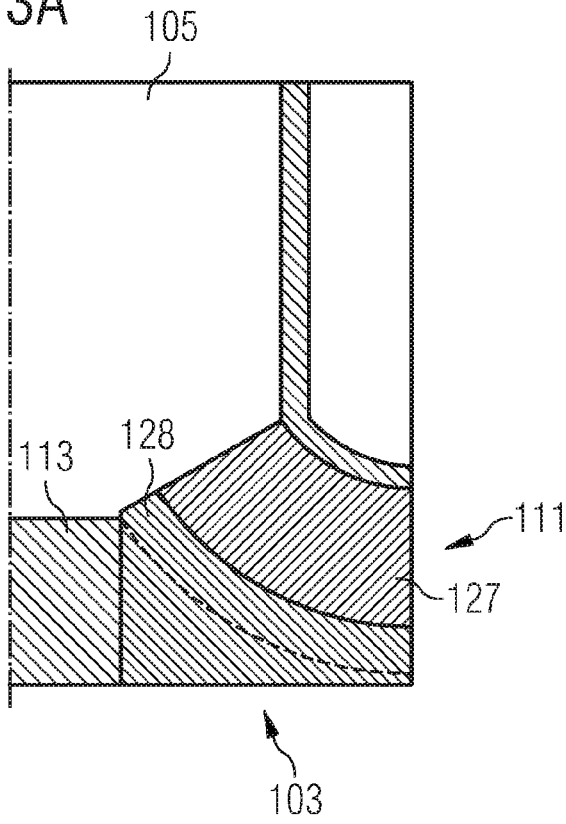
FIGS. 3*a* and 3*b* schematically show a second embodiment of the inventive combustor.
Figure 3B:
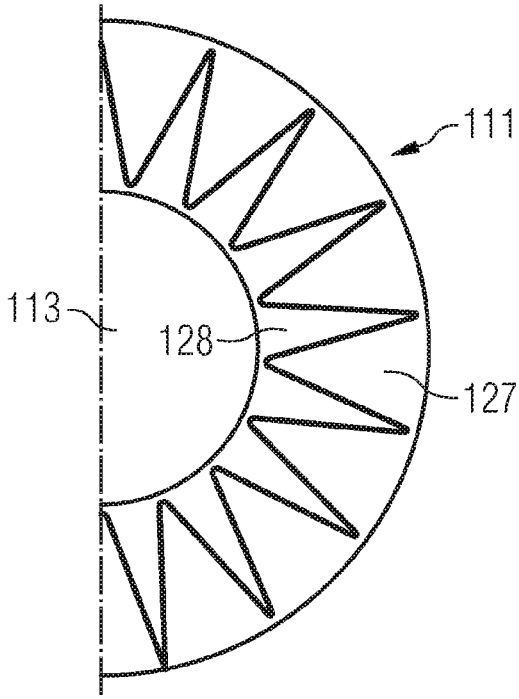

A second embodiment of the inventive combustor is shown in FIGS. 3*a* and 3*b*. FIG. 3*a* partly shows the swirler 111, the burner 103 and the pre-chamber 105 of the second embodiment in an axial section, and FIG. 3*b* shows the swirler 111 in a radial section. In contrast to the swirler 11 shown in FIGS. 2*a* and 2*b*, the swirler 111 of the second embodiment comprises first and second air passages 127, 128, respectively. The first and second air passages 127, 128, respectively, are interlocked with each other so as to introduce an effect whereby the streams of fuel air mixture emerging from the two passages 127, 128 wrap around each other. Such interlocked passages, i.e. passages with alternating geometries, could be machined easily with shaped cutters. The curvatures of the first and second air passages 127, 128 respectively, correspond to the curvatures of the air passages 17 in the first embodiment.

Figure 4B:
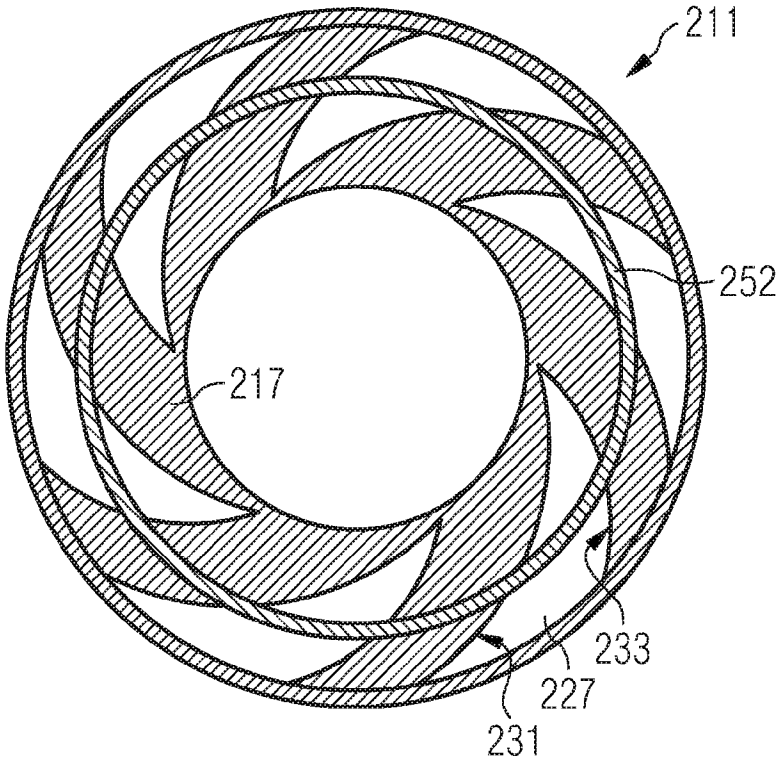
FIGS. 4*a* and 4*b* schematically show a third embodiment of the inventive combustor.
Figure 4A:
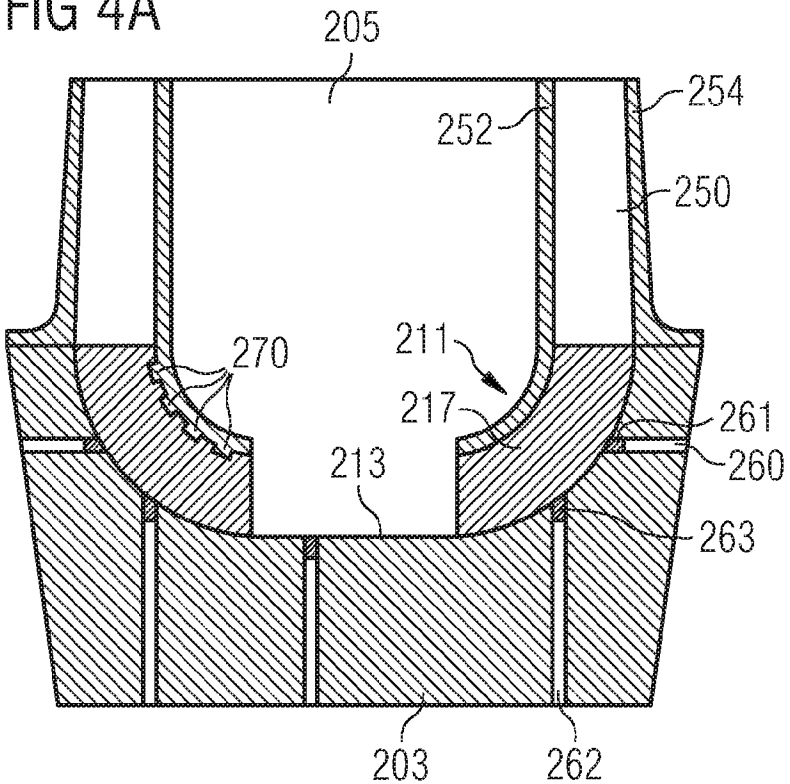

A third embodiment of the inventive combustor is partly shown in FIGS. 4*a* and 4*b*. While FIG. 4*a* shows the burner 203, the swirler 211 and a part of the pre-chamber 205 of the third embodiment in a longitudinal section FIG. 4*b* shows the swirler 211 of the third embodiment in radial section.

Further shown in FIGS. 4*a* and 4*b* is a cooling channel 250 which is formed between an inner chamber wall 252 and an outer chamber wall 254 of the pre-chamber 205. Through the cooling channel 250 cooling air flows in order to cool the inner wall 252 of the pre-chamber 205. The swirler 211 is in flow connection with the cooling channel 250 so that cooling air enters the swirler 211 after streaming through the cooling channel 250. The cooling channel could also be present between an outer and inner wall of a dome portion similar to the dome portion 15 in FIG. 1. In this case the pre-chamber and the main chamber would merge to one volume.

Figure 4C:
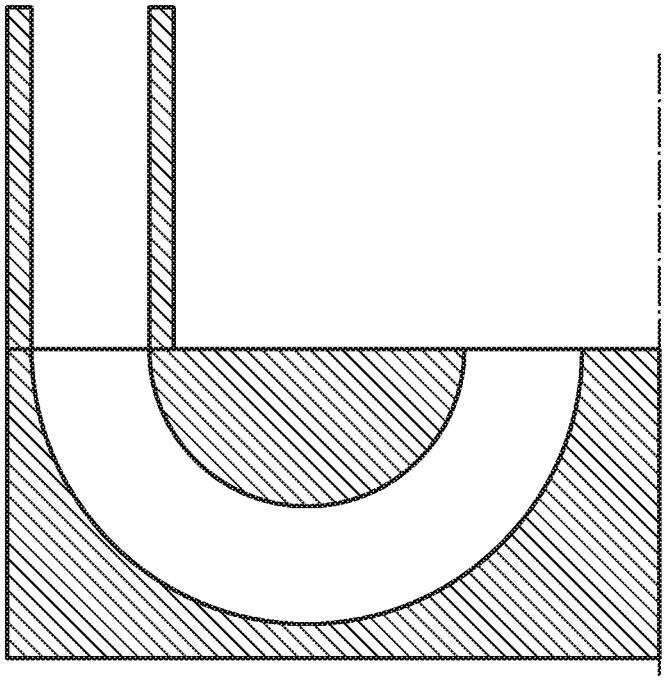
FIGS. 4*c* and 4*d* schematically show variations of the third embodiment of the inventive combustor.
Figure 4D:
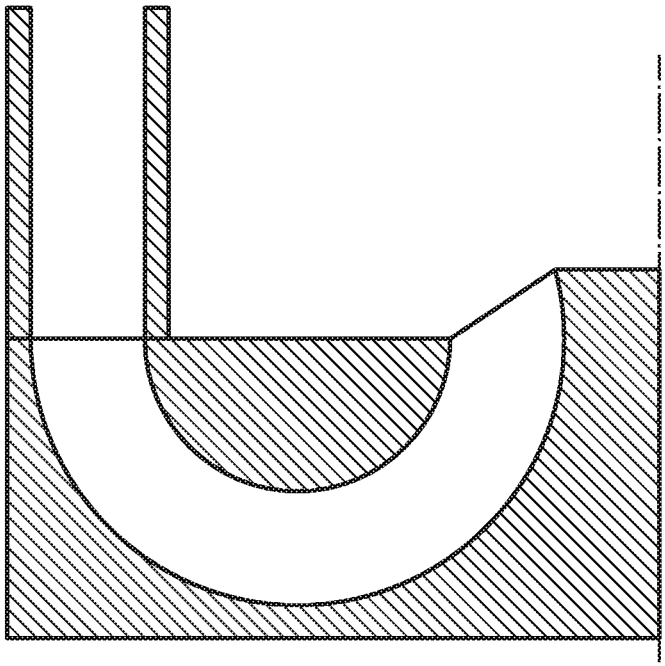

In the present embodiment, the swirler 211 includes six air passages 217 which are formed between neighboring vanes 227. However, any other number of air passages would also work. The curvatures of the vanes first and second sides 231, 233, respectively, are such that the curvatures peaks are lying on the same radius with respect to the symmetry axis S. Moreover, the radius of the curvatures of the sides 231, 233 are the same so that the air passages 217 have constant widths. The turning of the air passages 217 in an axial direction of the combustor is greater than in the first and second embodiments, namely 90°. In general, the turning could also be larger than 90°, e.g. 180° or even larger. The turning of the air passages 217 in a radial direction is about 70°. Air flowing into the swirler 211 from the cooling channel 250 is thus turned by 90° with respect to the axial direction and mixed with fuel fed through the ducts 260, 262 and injected through the injection openings 261, 263. When the air/fuel mixture streams into the pre-chamber 205 the streaming direction includes an angle with the symmetry axis S of 90° and an angle with the radial direction of at least 60°. A variant of the third embodiment in which turning of the air passages in the axial direction of the combustor is 180° is shown in FIG. 4C. A further variant, in which the turning angle exceeds 180° is shown in FIG. 4D. Such turning angles up to 180° and more are not restricted to the third embodiment but are in general possible.

Figure 5B:
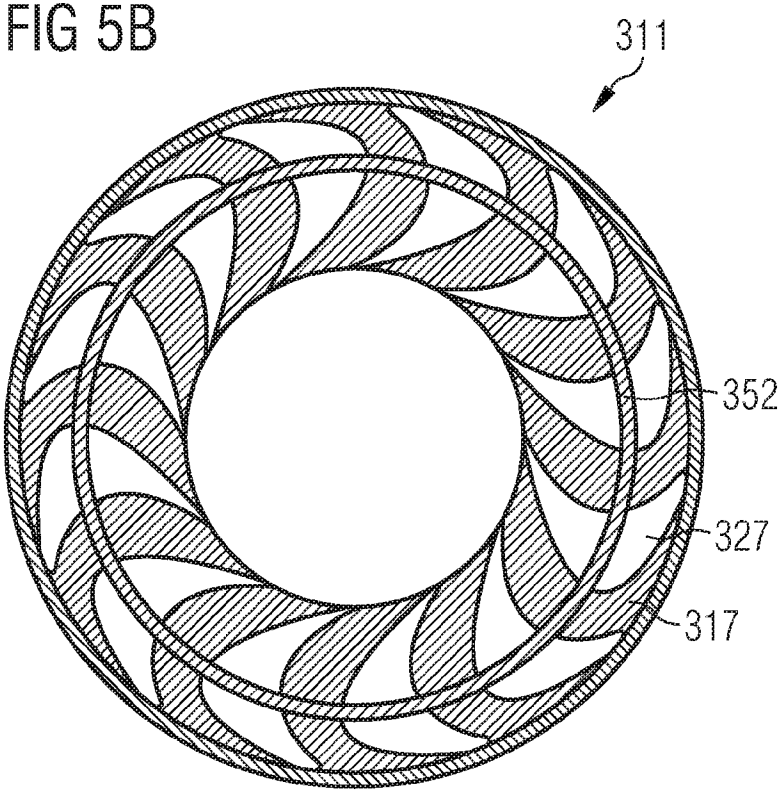
FIGS. 5*a* and 5*b* schematically show a fourth embodiment of the inventive combustor.
Figure 5A:
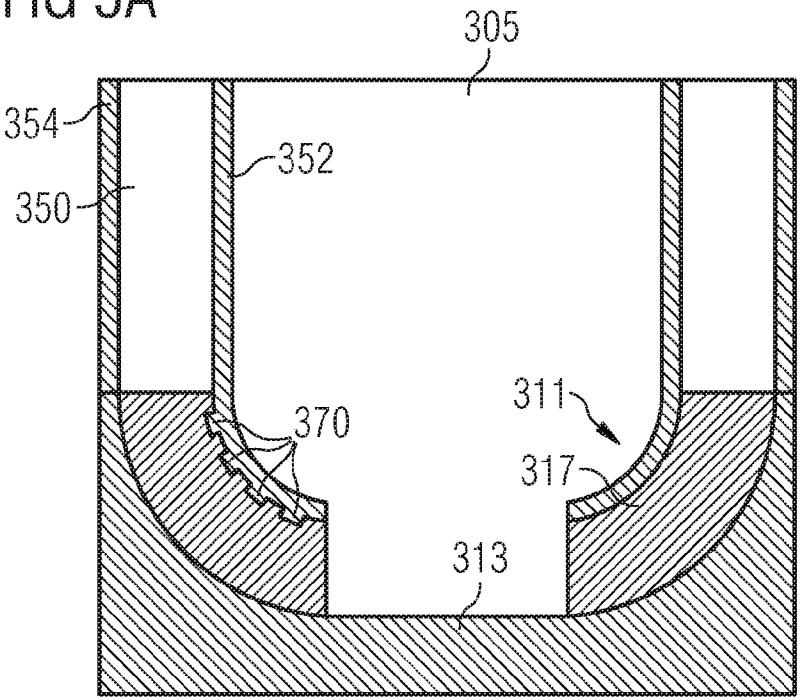

A fourth embodiment of the inventive combustor is shown in FIGS. 5*a* and 5*b*. FIG. 5*a* shows a longitudinal section through the swirler 311, the burner 303 and the pre-chamber 305 while FIG. 5*b* shows a radial section through the swirler 311. As in the third embodiment the swirler 311 is in flow connection with a cooling channel 350 formed between an inner wall 352 and an outer wall 354 of the pre-chamber 305. As already mentioned with respect to the third embodiment, the cooling channel could also be formed between an inner wall and an outer wall of a dome portion. The geometry of the air passages 317, in a longitudinal direction, corresponds to the geometry of the air passages 317 of the third embodiment while the geometry of the air passages 317, in a radial direction, corresponds to the geometry of the air passages 17 of the first embodiment.

Turbulence generating elements, so called turbolators, like the elements 270 and 370 shown in FIGS. 4*a* and 5*a* with respect to the third and the fourth embodiment, respectively, are an option in all embodiments. However, although shown in FIGS. 4*a* and 4*b* they do not need to be present in the third and fourth embodiment. Apart from further enhancing the mixing of fuel and air the advantage of the turbulators shown in the third and fourth embodiment is to cool the wall since it is an extension of the combustion chamber. Doing so the fuel air mixture will be further preheated in the same way as it takes place for air in the cooling channels 250, 350 and upstream thereof.

As mentioned with respect to the first embodiment, the number of air passages in the swirlers may be larger or smaller than shown in the embodiments.

The invention claimed is:

1. A gas turbine combustor, comprising:

a combustion chamber having an axial direction and a radial direction that comprises a pre-chamber and a main chamber following the pre-chamber in the axial direction, the pre-chamber having a smaller diameter than the main chamber;

a swirler comprising a plurality of vanes arranged in a circle with at least one air passage defined between a pair of adjacent vanes, wherein the air passage feeds an air stream into the pre-chamber, the air passage being configured to guide a flow between said adjacent vanes from a radially outer inlet to a radially inner outlet, and a fuel injection opening that is located in the air passage, wherein the vanes are configured such that the air passage is curved in the axial direction and the radial direction, the air passage being oriented so that a flowing direction of the air stream flowing into the pre-chamber comprises an angle with the radial direction to introduce a swirl in the air stream and an angle with the axial direction of at least 60°; and wherein the air passage is configured to define a turning flow path with a turning between 70° and 150° in the radial direction and a turning between 0° and 235° in the axial direction.

2. The gas turbine combustor as claimed in claim 1, wherein an inlet opening of the air passage is in a flow connection with a cooling channel of the combustion chamber.

3. The gas turbine combustor as claimed in claim 1, wherein a dimension of the air passage varies along the turning in the radial direction.

4. The gas turbine combustor as claimed in claim 1, further comprising a further air passage that is interlocked with the air passage.

5. The gas turbine combustor as claimed in claim 1, further comprising a further fuel injection opening that is located in a different location in the air passage of the fuel injection opening.

6. The gas turbine combustor as claimed in claim 1, wherein an exit portion of the air passage is oriented so that the flowing direction of the air stream flowing into the pre-chamber comprises the angles with the radial direction of at least 45°.

7. The gas turbine combustor as claimed in claim 1, wherein the fuel injection opening comprises a liquid fuel injection opening and a gaseous fuel injection opening.

8. The gas turbine combustor as claimed in claim 1, wherein the turning in the axial direction is less than 90°.

9. The gas turbine combustor as claimed in claim 8, wherein the turning in the axial direction is between 15° and 75°.

10. A method for mixing a fuel and an air stream in a gas turbine combustor, comprising:

providing a combustion chamber having an axial direction and a radial direction and comprising a pre-chamber and a main chamber following the pre-chamber in the axial direction, the pre-chamber having a smaller diameter than the main chamber;

providing a swirler comprising a plurality of vanes arranged in a circle with at least one air passage defined between a pair of adjacent vanes, the air passage configured to guide a flow between said adjacent vanes from a radially outer inlet to a radially inner outlet, feeding the air stream into the pre-chamber via the air passage, the air passage being curved in the axial direction and the radial direction;

orienting the air passage so that a flowing direction of the air stream flowing into the pre-chamber comprises an angle with the radial direction to introduce a swirl in the air stream and an angle with the axial direction of at least 60°;

defining a turning flow path by the air passage with a turning between 70° and 150° in the radial direction and a turning between 0° and 235° in the axial direction; and locating a fuel injection opening in the air passage for injecting the fuel.

* * * * *